United States Patent [19]

Post

[11] 4,270,877

[45] Jun. 2, 1981

[54] WORKING PLATFORM

[75] Inventor: Adrianus J. Post, Heiloo, Netherlands

[73] Assignee: Steven Baggeren V.V., Beverwijk, Netherlands

[21] Appl. No.: 962,617

[22] Filed: Nov. 21, 1978

[30] Foreign Application Priority Data

Dec. 9, 1977 [NL] Netherlands ..... 7713674

[51] Int. Cl.[3] ..... E02B 17/08

[52] U.S. Cl. ..... 405/198; 405/195; 405/196; 254/105

[58] Field of Search ..... 405/196–202; 280/5.2, 5.3; 180/8 R, 8 C, 8 D, 8 E; 254/105–112

[56] References Cited

U.S. PATENT DOCUMENTS

| | | | |
|---|---|---|---|
| 3,135,345 | 6/1964 | Scruggs | 180/8 E |
| 3,435,621 | 4/1969 | Johnson | 405/198 |
| 3,612,201 | 10/1971 | Smith | 405/201 X |
| 3,734,220 | 5/1973 | Smith | 180/8 E |

FOREIGN PATENT DOCUMENTS

| | | | |
|---|---|---|---|
| 2654826 | 12/1976 | Fed. Rep. of Germany | 405/202 |
| 7400716 | 7/1975 | Netherlands | 405/202 |
| 934369 | 8/1963 | United Kingdom | 405/196 |
| 1079250 | 8/1967 | United Kingdom | 405/197 |

*Primary Examiner*—Dennis L. Taylor

*Attorney, Agent, or Firm*—Kenyon & Kenyon

[57] ABSTRACT

Floating apparatus for performing operations, such as dredging and drilling, on and in a bottom under water subject to violent motion. The apparatus comprises a working platform provided with legs vertically adjustable to the depth of the bottom by adjusting means. Each leg is flexibly connected at least at two vertically spaced places to parts of the apparatus formed integrally with the platform. The connection of a leg at the higher of the two places is effected by means for taking up rocking movements of the working platform, and at the lower of the two places by connecting members springing and/or dampening in two perpendicular horizontal directions, while the means adjustable in the vertical direction for connecting the leg to the working platform are also of resilient or dampening construction.

7 Claims, 8 Drawing Figures

WORKING PLATFORM

Figure 1:
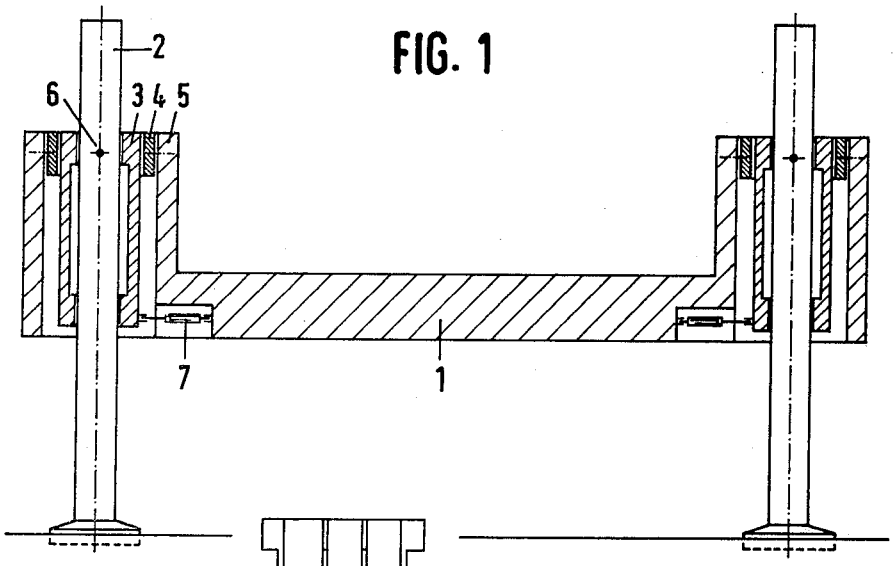

This invention relates to a working platform for offshore work, which can be transported in floating condition and, arrived at a particular site, can be supported on the water bottom by means of legs. The difficulties occurring during the action of high waves, especially when the legs contact the bottom, are described for example in our Dutch patent application No. 7400716. That application especially concerns a working platform which is transported in the floating condition, and is hoisted or jacked up from its legs ("jack-up" construction).

However, in addition to legs movable upwardly and downwardly, the working platform may be provided with one or more floating bodies provided at some distance below it (so-called "semi-submersible"). When the platform has arrived at its destination, the floating body is flooded after the legs have been adjusted so that when they rest on the bottom the working platform is maintained at a sufficient level for it to experience no trouble from wave action. This construction has the advantage that when the legs touch the bottom the floating body is no longer in interaction with the waves at the surface of water.

In the prior patent application referred to above, there is indicated a particular construction for taking up the vertical shock when the legs touch ground. In the case of very large working platforms and highly turbulent water, however, even this construction is insufficient. In particular, impermissible loads may be generated in directions other than the vertical direction.

According to the present invention there is provided a floating apparatus for performing operations, such as drilling and dredging, in the bottom of water subject to turbulent movement, comprising a working platform provided with legs which by adjusting means are vertically adjustable with respect to the platform according to the depth of the bottom, which apparatus is characterised in that each leg is flexibly connected at at least two vertically spaced places to parts of the apparatus formed integrally with the working platform, that the connection of a leg at the higher of the two places is effected by means of a device for taking up rocking movements of the working platform and at the lower of said two places by means of connecting members springing and/or dampening in two perpendicular horizontal directions, the means for vertically adjusting the legs with respect to the working platform being also of resilient or dampening construction.

The rocking movements referred to normally consist for the most part of rotational movements which, however, may be combined with translatory movements.

In a particular embodiment according to the present invention, the construction is such that the working platform can "walk" over the bottom. It then has at least two pairs of retractable legs. The legs of each pair are move up and down jointly or separately. In at least one pair, the legs are in addition each separately movable relatively to the working platform in the horizontal direction. When the legs are alternately lowered, raised, and moved in the horizontal direction the platform can be displaced stepwise.

A construction with which this is possible will be described in more detail hereinafter. In principle, however, various well-known constructions which make such "walking" movements possible can be used.

The flexible connection of each leg to the working platform at the respective upper one of the two positions referred to, such that rocking movements of the working platform can be taken up, can be implemented by means of resilient elastic shock-absorbing connection members. In a preferred embodiment of the present invention, however, the connection is effectuated by means of a mechanical device, namely, a universal joint device.

The flexible connection of each leg to the working platform at the respective lower one of the two positions referred to can also be realized by means of resilient or elastic connection members. Preferably, however, use is made of connection members between the working platform and the leg, which are formed so that external forces in the horizontal direction, which may occur owing to the interaction of the working platform, under the influence of wave action, and the leg, possibly to the extent these exceed a pre-determined value, can be neutralized. This can be realized, for example, with a device in which these forces are transferred via a medium which moves under the influence thereof and which, during this movement, experiences such a resistance that the kinetic energy is converted into heat substantially in full, or at least in part. A suitable mobile medium is, for example, a liquid, such as oil or water, which under the influence of the forces referred to is forced, for example, through a throttle valve. A suitable embodiment of a connection member satisfying the requirements referred to is a hydraulic cylinder. The leg of the working platform is then connected to the piston of the cylinder and the working platform proper to the outer wall of the cylinder, or the other way round.

British Pat. No. 1,078,607 indicates a construction in which a hydraulic cylinder can be used both for taking up shocks and for the relative movement of the parts respectively connected to the piston and the outer wall of the cylinder.

Some embodiments of the present invention will now be described, by way of example, with reference to the accompanying drawings.

In said drawings

Figure 2:
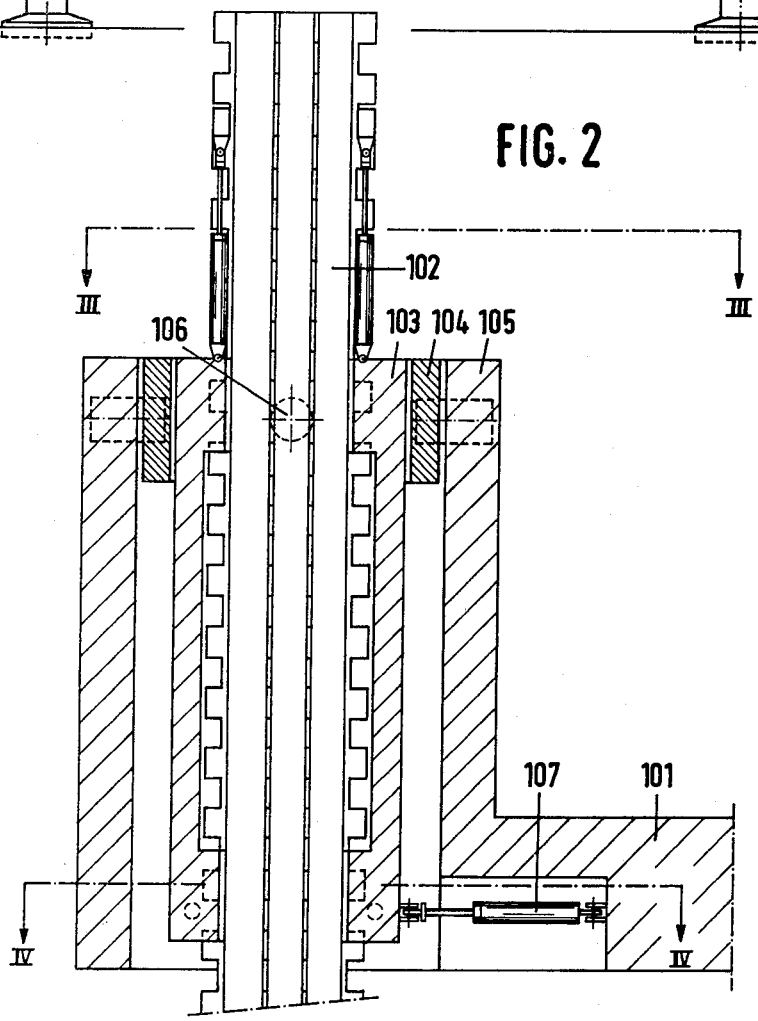
Figure 3:
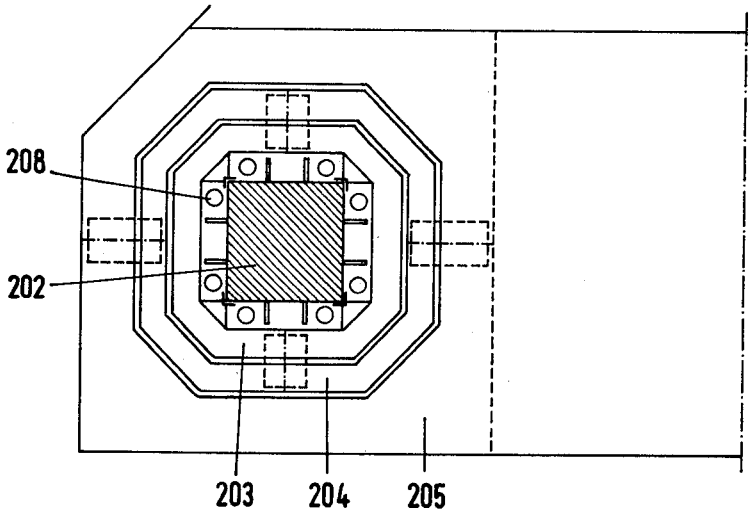
Figure 4:
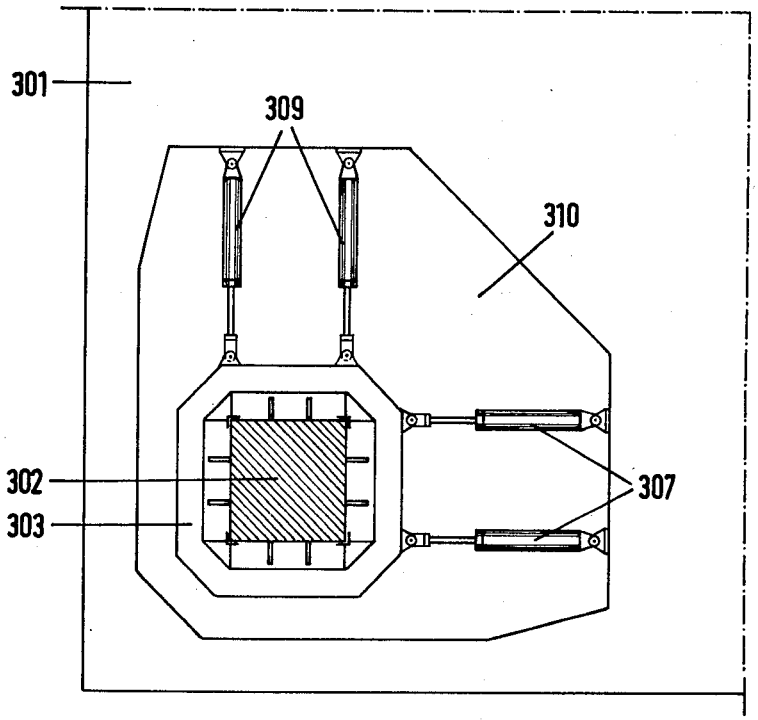
Figure 5:
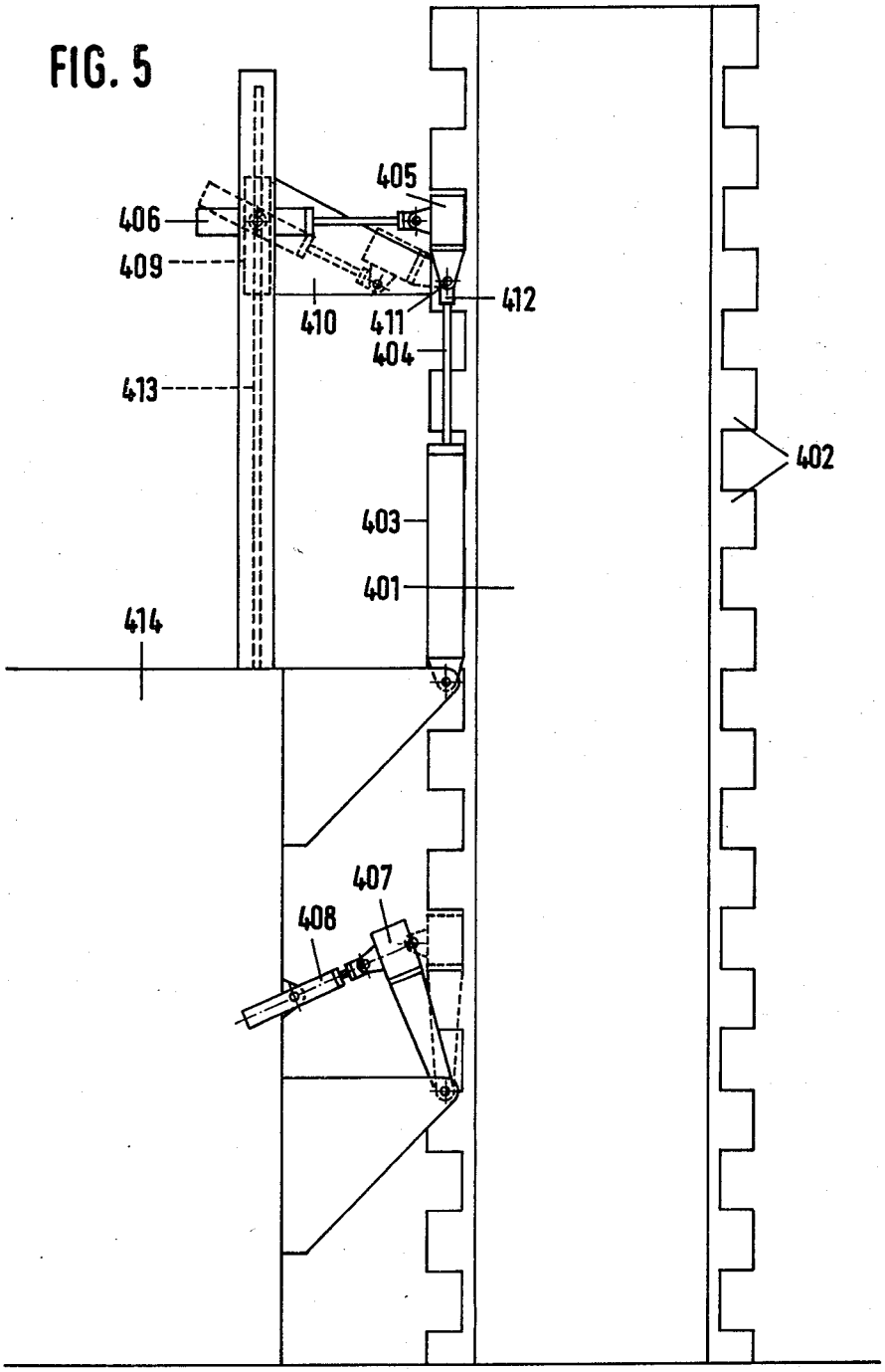
Figure 6:
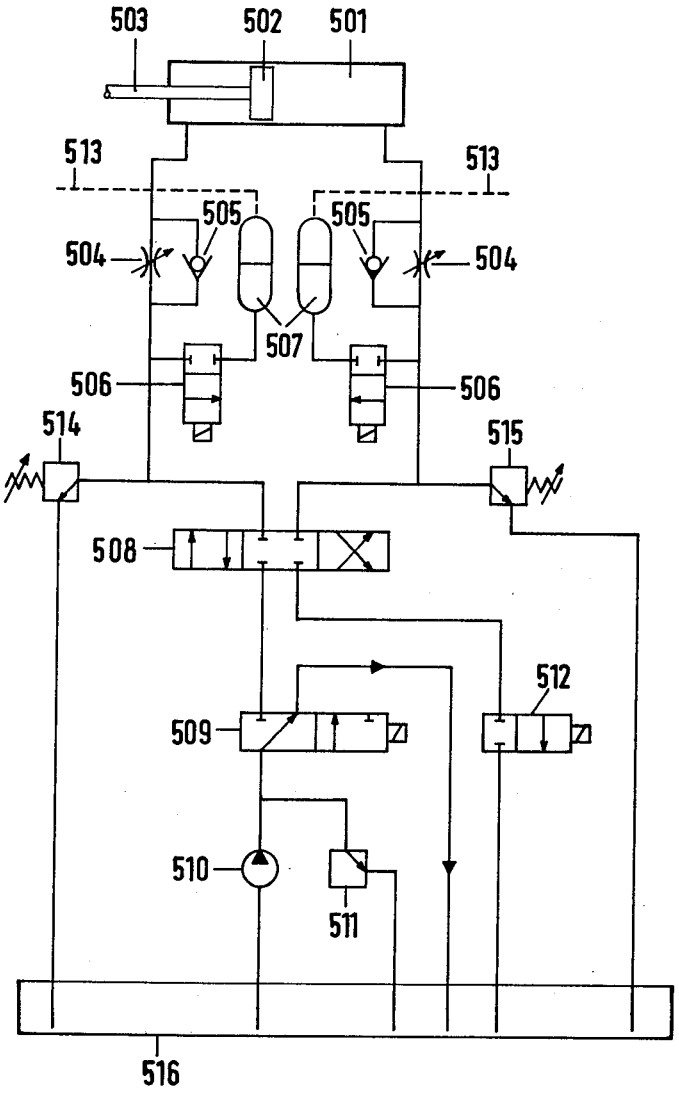

FIG. 1 is a cross-sectional view of a portion of a "jack-up" construction according to the present invention, FIG. 2 is a diagrammatic cross-section of a portion of a leg with the surrounding parts of the working platform, illustrated in more detail, FIG. 3 is a part-sectional plan view, taken on the line III—III of FIG. 2, FIG. 4 is a part-sectional plan view taken on the line IV—IV of FIG. 2, FIG. 5 shows a leg raising system, which is also a vertical buffer system and a locking system, FIG. 6 is a basic scheme of the hydraulic system as to be used for both vertical and horizontal buffering.

Figure 7:
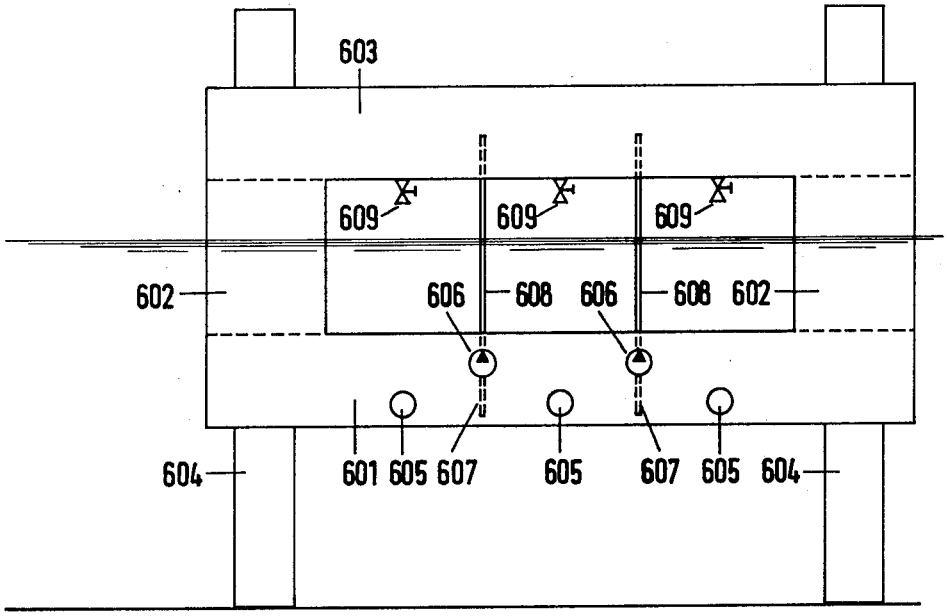
Figure 8:
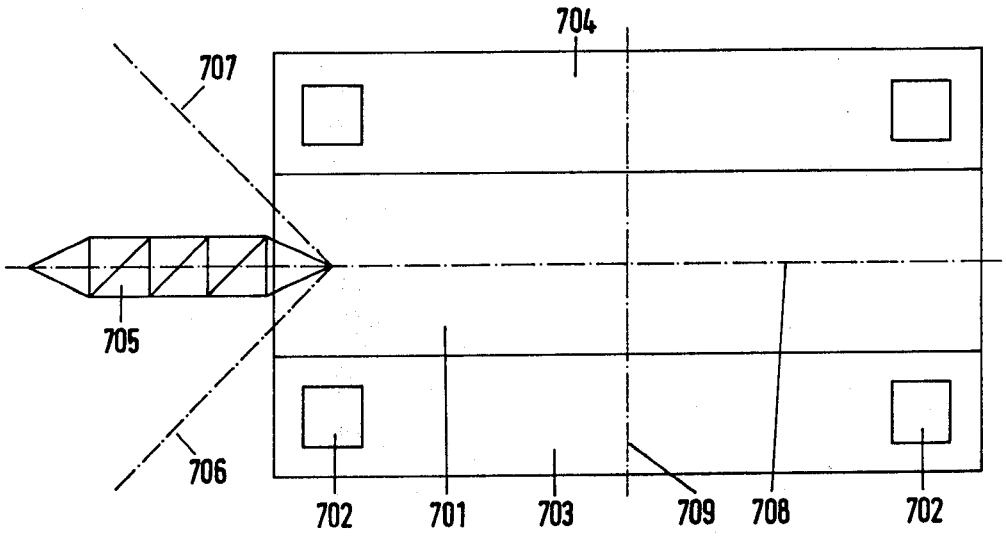

FIG. 7 is diagrammatic side-elevational view of a platform according to the present invention constructed as a semi-submersible, and FIG. 8 is a plan view of the top deck of a platform, showing two ballast systems and a crane.

Referring particularly to FIG. 1, there is shown a diagrammatic cross-sectional view of a portion of a "jack-up" embodiment according to the present invention. There is shown a working platform 1, which can be hoisted from legs 2. Designated by 3 is a buffer frame mounted in gimbals 4. The gimbals proper are mounted in a housing 5 formed integrally with the working platform. Designated by 6 is the point about which the leg can perform rotary movements relative to the working platform. For displacing leg 2 in the horizontal direction, there are provided hydraulic cylinders, one of which is shown at 7. This cylinder also serves for absorbing and/or as a buffer for shocks active in the horizontal direction, which will be described in more detail hereinafter.

FIG. 2 is a diagrammatic cross-sectional view of a portion of a leg, showing the surrounding parts of the working platform in more detail.

There is shown a working platform 101, a leg 102, a buffer frame 103, gimbals 104, a housing 105 mounting the gimbals, the pivot 106 of the leg, and a hydraulic cylinder 107, having the above dual function.

FIG. 3 is a part-sectional plan view, taken on the line III—III of FIG. 2, and shows a leg 202, buffer frame 203, gimbals 204 and a housing 205 mounting the gimbals. Lifting cylinders are indicated at 208.

FIG. 4 is a part-sectional plan view, taken on the line IV—IV of FIG. 2. Indicated at 301 is a portion of the working platform with a recess 310. Provided in the recess are hydraulic cylinders 307 for "longitudinal" movements of the leg and hydraulic cylinders 309 for lateral movements. As stated before, the hydraulic cylinders also have a shock absorbing and/or buffer function when the legs come into interaction with the bottom. The leg is shown at 302 and the buffer frame at 303.

FIG. 5 illustrates the lifting system for a leg, which at the same time is a vertical buffer system and a locking system. The system is shown for one side of leg 401 only. Provided on the leg are teeth 402, which can be engaged by lifting blocks 405 and locking blocks 407. When locking block 407 is moved between the teeth by means of cylinder 408, the leg is locked from displacement. When this block 407 is retracted, the leg is free to be moved by means of lifting block 405, which by means of piston rod 404 is connected to cylinder 403. The lifting block can be moved into and out of engagement with the teeth by means of cylinder 406. As the piston rod 404 moves up and down, cylinder 406 should also move up and down. This is achieved by connecting a sliding block 409 by means of an arm 410 to the piston rod head 412 at shaft 411. Sliding block 409 now slides up and down guide 413 with the piston rod movement and takes along cylinder 406. If it is assumed that the starting point is the position of lifting block 405 and locking block 407 as shown, the process can be followed. If piston rod 404 is retracted, leg 401 moves downwardly with respect to the platform. In the lowermost position, locking block 407 is brought into engagement with the tooth. Subsequently block 405 is raised again by means of cylinder 403 after block 405 has been withdrawn from the teeth. In the uppermost position this block is then again brought between the teeth 402, and block 407 subsequently drawn out if the leg has been pulled slightly downwardly with respect to the platform. Then a next cycle can begin. For moving the leg upwardly with respect to the platform, the reverse order is followed.

In order for the system to be used as a buffer system, piston rod 404 is placed in the central position with block 405 between teeth 402. Block 407 is moved out of the teeth, and the system can freely spring, if connected to a system as shown in, for example, FIG. 6. In FIG. 5 cylinder 403 and locking block 407 are connected to pontoon 414.

In the system as shown in FIG. 3, the cylinders and locking blocks are arranged in four sets. The eight cylinders are divided over four groups of two cylinders each, each pair being connected to a lifting block. Provided on each side of the leg is one locking block, which can engage the teeth. There are two rows of teeth on each side.

FIG. 6 is a basic scheme of the hydraulic system as to be used for both vertical and horizontal buffering. A construction as mentioned in Dutch patent 142,746 is less suitable in the present case of horizontal buffering, but can possibly be used for vertical buffering.

The system of FIG. 6 is intended to establish equilibrium between the forces acting on opposite sides of the piston, with the liberty of determining the position of equilibrium. By adjusting the pressures on opposite sides of the piston to be inversely proportional to the piston area on opposite sides, the forces acting on the piston can be equalized, and the cylinder can in principle be caused to remain stationary in any position. The position of the piston can be determined by controlling the amounts of oil and air on opposite sides. The stiffness of the system, too, is determined by controlling the amounts and pressures. Certainly in the horizontal buffering system, it is desirable to take the central position as the starting point. For vertical buffering, this is also the case, although for that purpose it may be considered to place the piston in the bottom of the cylinder as the legs are lowered, and, on the other hand, position the piston in the top as the legs are released from the ground.

The operation will now be described with particular reference to FIG. 6: Mounted for movement in cylinder 501 is a piston 502, connected through a piston rod 503 to the element to be buffered. Adjustable quantity regulators 504 control the velocity at which piston 502 can move in a given direction (throttling effect), and at the other side of the piston hydraulic fluid can freely enter through non-return valve 505.

When valves 506 are opened and valve 508 is kept closed the systems on opposite sides of the piston are in direct communication with accumulators 507.

When oil is supplied from pump 510, via slide valves 508 and 509, to the two systems, these can be successively provided with oil, and they can be pressurized by means of compressed gases through conduits 513. During this process valve 512 is closed. The pressures and quantities of oil are adapted to the desired position of the piston in the cylinder and the desired pressures in the system.

When valve 508 is now closed, the system is ready for buffering. Valves 512 and 509 can now also be re-set for enabling free circulation of oil by pump 510 via tank 516. When the leg strikes the ground, it will be displaced relatively to the platform, resulting in a movement of piston 502. The velocity is determined by valve 504. When the platform has all its legs supported on the ground, the quantity regulator 504 is slowly closed, and the platform comes to a standstill. Then valves 506 are closed to disable the buffer effect, and valves 504 are re-opened. The system is now suitable for the controlled displacement of piston 502 in cylinder 501 (for the "walking" movement or the raising or lowering movement). During these operations valve 512 remains in the open position, and valves 508 and 509 are also opened. Depending on the position of valve 508, the piston will move in either direction in the cylinder. The velocity of the displacement is determined by valve 504. Valves 508 and 509 can possibly be combined.

It will be clear that for the buffering operation valve 504 can be replaced by an adjustable pressure control valve, which acts as a kind of safety valve. The movement of the piston can also be stopped by increasing the pressure during buffering. However, controlled displacement of the piston in the cylinder would yet require the incorporation of a quantity regulator (throttle valve).

Safety valves 514 and 515 serve for setting the maximum permissible forces on the cylinder, and overflow in the case of excessive supply of oil by pump 510.

According to one aspect of the invention, applied to a semi-submersible (platform), use is made of a particular ballast system to keep the interaction between the semi-submersible and the waves as short as possible during moments when the legs hit the ground, or are just fast or just not yet detached.

For this purpose the working deck is equipped with ballast tanks, there being further provided means for rapidly filling the ballast tanks of the floating body with water, means for pumping water from the ballast tanks of the floating body to the ballast tanks of the working deck, and means for rapidly emptying said ballast tanks.

FIG. 7 diagrammatically illustrates such a construction for a semi-submersible.

The semi-submersible comprises floating bodies 601 provided with ballast tank and located in the water, columns 602, and working deck 603 provided with ballast tanks and located above the water. Extending through columns 602 are legs 604. The elements for buffering, raising, lowering and "walking", described with reference to the preceding figures, are mounted in the columns.

The system is based on the ballast tanks in the floating body or bodies 601 being filled in an extremely short period of time when very large valves 605 positioned under the water level, are opened. The tanks of the floating bodies 601 are then flooded, and the platform sinks until it is firmly supported on its legs 604. In order that the sinking period may be kept as short as possible, the legs, which are provided with a lifting system, are moved to a reasonable level above the ground before the flooding of the tanks is started.

When the ballast tanks of the floating bodies are filled, the valves 605 are closed, and ballast water is pumped from the floating bodies 601 to the working deck 603 with pumps 606 via suction pipes 607 and pressure pipes 608.

When sufficient ballast water has been transferred, the system is ready for being rapidly refloated. The starting point in this connection is that the legs of the platform should come to be sufficiently clear from the bottom.

For rapidly refloating the platform, the large deck valves 609 are opened. The water drains very quickly from the tanks of the working deck 603 through gravity, so that the legs 604 of the platform are free from the ground in a short period of time.

During the settling and refloating operations, use is made of the buffer systems. It will be clear that during these operations, not only should the energy due to the movement of waves be taken up, but also that of the lowering, and in a negative sense, of the rising of the installation.

Naturally, a comparable system could be constructed with a pontoon in the water line with tanks under and above the water level, with means being provided for the entry of water through hydrostatic pressure and the exit of water through gravity. Combinations with removal of water by means of air and/or gas pressure are possible, and so is the use of pumps during deballasting and/or ballasting as per the system described above.

In order that, during the period when the platform is supported on the bottom, the forces acting on the legs may be limited when heavy loads are shifted on board, the platform may be equipped with a second ballast system. In it, the moment arising as a result of the displacement of loads on board is compensated by the counter displacement of ballast water. The ballast system referred to may be mounted in or on the working deck, the columns, and/or the floating bodies.

This can be of importance, for example, during the swivelling of a crane on board. FIG. 8 is a plan view of the top deck of the platform, showing legs 702 in the four corners and two ballast tanks 703 and 704. Mounted on the deck is a derricking crane 705, which can swing through certain angles, for example, from position 706 to position 707. Possibly, the crane may be able to turn through a complete circle.

The system will be best understood, starting from the central position 705. When the crane is moved to position 706, at the same time ballast water simultaneously is pumped from tank 703 to tank 704. As a consequence the moment about axis 708 is constant, and consequently the load on the legs will neither increase nor decrease. In this figure the effect about axis 708 is shown only. It is clear that a similar result can be achieved about an axis 709 perpendicular to axis 708, when water should also be displaced transversely to axis 709.

This system can also be employed during the swinging of a load in floating condition.

What I claim is:

1. Floating apparatus for performing operations such as drilling and dredging in the bed of a body of water subject to turbulent movement, the apparatus including a working platform, a plurality of legs for supporting said platform from the bed of the body of water, means for supporting each leg for vertical movement with respect to the platform, and means for vertically adjusting each leg according to the depth of the bed from the surface of the water, wherein the improvement comprises:

means for pivotally connecting each leg support means to the platform at a first level of the platform and means extending between each leg support means of at least a pair of said legs and the platform in two mutually orthogonal directions at a second level of the platform, spaced vertically from the first level, for resiliently damping pivotal movement between said legs and the platform; and said means for vertically adjusting each leg comprises means for selectively resiliently damping vertical movement of the leg with respect to the platform.

2. Apparatus according to claim 1 wherein said means extending between the leg support means and the platform at the second level comprise means for selectively pivotally adjusting said pair of legs with respect to the platform.

3. Apparatus according to claim 1 wherein said means for pivotally connecting each leg support means to the platform comprises a gimbal device.

4. Apparatus according to claim 1 wherein said means extending between a leg support and the platform at the second level of the platform comprise hydraulic cylinder and piston devices extending in mutually orthogonal directions, mean for delivering hydraulic fluid under pressure to a selected side of each piston to extend or retract said hydraulic devices to pivotally adjust said leg, and a bypass conduit connecting the opposite ends of the cylinder and having flow restricting means for damping pivotal movement of said leg.

5. Apparatus according to claim 3 wherein said flow restricting means is adjustable.

6. Apparatus according to claim 3 or 4 wherein said bypass conduit further includes a spring-loaded accumulator.

7. Apparatus according to claim 5 wherein said spring-loaded accumulator comprises air spring.

* * * * *

UNITED STATES PATENT AND TRADEMARK OFFICE

CERTIFICATE OF CORRECTION

PATENT NO. : 4,270,877

DATED : June 2, 1981

INVENTOR(S) : Adrianus J. Post

It is certified that error appears in the above—identified patent and that said Letters Patent is hereby corrected as shown below:

On page 1 of patent document, correct spelling of assignee's name from "Steven Baggeren V.V." to --Stevin Baggeren B.V.--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*